US006047933A

United States Patent [19]

Hoover

[11] Patent Number: 6,047,933

[45] Date of Patent: Apr. 11, 2000

[54] SWING ARM SUPPORT FOR MAILBOX

[76] Inventor: Earl H. Hoover, 3998 Rte. 14A, Penn Yan, N.Y. 14527

[21] Appl. No.: 09/057,322

[22] Filed: Apr. 9, 1998

[51] Int. Cl.[7] ..... B65D 91/00

[52] U.S. Cl. ..... 248/219.2; 248/145; 248/415

[58] Field of Search ..... 248/219.2, 145, 248/415, 137, 900, 289.31; 232/39

[56] References Cited

U.S. PATENT DOCUMENTS

| | | | |
|---|---|---|---|
| 1,273,696 | 7/1918 | VanHoof | 248/145 |
| 1,377,084 | 5/1921 | McDill | 248/145 |
| 1,440,043 | 12/1922 | Wright | 248/145 |
| 1,645,768 | 10/1927 | Morten, Jr. | 248/145 |
| 2,079,510 | 5/1937 | King et al. | 248/145 |
| 2,149,050 | 2/1939 | Hajicek | 248/145 |
| 2,550,338 | 4/1951 | Dunagan | 248/145 |
| 2,995,330 | 8/1961 | Alms | 248/145 |
| 3,465,994 | 9/1969 | Block | 248/145 |
| 3,802,656 | 4/1974 | Virblas | 248/145 |
| 3,881,650 | 5/1975 | Schmidt | 232/39 |
| 3,899,150 | 8/1975 | Racquet | 248/145 |
| 3,999,702 | 12/1976 | Conroy | 232/39 |
| 4,363,460 | 12/1982 | Carroll | 248/415 |
| 4,995,576 | 2/1991 | Kieswetter | 248/145 |
| 5,150,482 | 9/1992 | Shapiro | 4/562.1 |
| 5,215,283 | 6/1993 | Gould | 248/145 |
| 5,445,086 | 8/1995 | Bolduc | 232/39 |
| 5,524,853 | 6/1996 | Varlaro | 232/39 |

FOREIGN PATENT DOCUMENTS

| | | | |
|---|---|---|---|
| 208250 | 10/1955 | Australia | 248/289.31 |

*Primary Examiner*—Ramon O. Ramirez
*Assistant Examiner*—Kimberly Wood
*Attorney, Agent, or Firm*—Wall Marjama Bilinski & Burr

[57] ABSTRACT

A moveable support arm for a mailbox which includes a cylindrical cap which is sized to fit over a vertical support post. The cap has an open bottom and a closed top with a horizontal support member being attached to said cap, and containing means to attach and support a horizontal post in fixed engagement.

4 Claims, 2 Drawing Sheets

SWING ARM SUPPORT FOR MAILBOX

FIELD OF THE INVENTION

This invention relates generally to a mailbox support structure, and more specifically to a swingable mailbox.

BACKGROUND OF THE INVENTION

The present invention relates to a post mounted mailbox assembly, and more specifically to a swing arm support for a mailbox which allows the mailbox to swing or rotate in a horizontal axis when disturbed or impacted.

Mailboxes in rural or residential areas are commonly supported on an upstanding vertical post located adjacent a roadway where mail is delivered. They often include a vertical post which contains a horizontal support beam to position the mailbox at an appropriate location where the mail is to be delivered. On occasion, a mail delivery truck will inadvertently be driven into and/or contact the mailbox as a result of the driver attempting to position the mail delivering vehicle to a point within arms length access of the mailbox. This event usually damages or destroys the mailbox and its supporting structure. In addition, snow plows, buses, automobiles and other vehicles also occasionally are driven off the roadway and collide with roadside mailboxes and/or their supporting structure. A common threat to a fixed mailbox assembly results from the removal of snow being pushed by snow plows which either damages or destroys the mailbox and/or supporting structure. In any of the above cases, the mail box and/or its supporting structure is usually damaged to the point where it cannot be repaired, and is unsuitable for further use. When this event occurs during winter, when the ground is frozen, it becomes a significant hardship on the owner of the mailbox to attempt to have it replaced when the ground is frozen solid. This event results in a great inconvenience on the part of the homeowner who may have to wait until when the ground thaws before the mailbox support structure can be replaced.

The prior art is replete with numerous structures which attempt to address the above described problem by providing a moveable or swinging mailbox support in an attempt to overcome the problems described above.

U.S. Pat. Nos. 3,802,656; 1,645,768; and 1,440,043 teach the use of a swingable support for a mailbox, and have the common feature in which a vertical moveable post or pipe is telescoped within the inner diameter of a lower support post, with the top post supporting the mailbox, and being allowed to rotate within the bottom post when the mailbox and its support are deflected or hit by a moving object. This disadvantage associated with this structure is that in cold and freezing weather the telescoping arrangement can freeze solid, and resist rotation, and when hit by a moving object will break or snap off due to the vertical moveable post being immobilized due to being frozen solid within the lower support member. This structure, therefore, presents certain problems with regard to its use in cold weather.

A variation of the above concept is set forth in U.S. Pat. No. 5,445,086 which provides for rotation through a bracket-pipe arrangement which is attached to a support post.

U.S. Pat. Nos. 1,273,696 and 5,524,853 are directed to swingable mailbox supports which are used in conjunction with spring members to allow the mail box to freely rotate about a central axis in the event of a collision with the springs functioning to restore the mailbox to its initial position. These structures are complex in their design, and require that the springs and associated hardware be in proper register and adjustment for the devices to work reliably.

U.S. Pat. Nos. 2,079,510; 2,149,050; 2,550,338; 2,995,330; and 3,881,650 are also directed to swingable or moveable mailbox devices, but teach complex structures which appear to be expensive to manufacture, and impractical in operation.

It is therefore an object of the present invention to provide a swing arm support for a mailbox which overcomes the problems of the prior art noted above.

Is a further object of the present invention to provide a swing arm support for a mailbox which is reliable in operation and economical to manufacture.

As a further object of the present invention to provide a swing arm support for a mailbox which is reliable in operation, and is easy to maintain.

SUMMARY OF THE INVENTION

Present invention is directed swing arm support for a mailbox which is positioned on top of a vertical support post, and which further includes a horizontal support member to support the mailbox. The swing arm support includes a cylindrical cap member which is sized to fit over the top of a vertical support post which is fixed in the ground. The cap has an open bottom and is closed at the top. The cap member is connected to a horizontal support member which contains means, such as bolts or screws, for attaching a second horizontal member such as a wooden post which directly supports the mailbox at a predetermined distance from the vertical support post. The cap member preferably contains a central hole in its top surface to accommodate a screw and associated friction pad, which depending on how tight the screw is maintain with respect to the top surface of the cylindrical cap member, controls the degree of friction or resistance the swing arm support will have with respect to deflecting a blow or force to the mailbox and/or mailbox support assembly. The cylindrical cap member is sized so that it fits loosely over a vertical support post with friction or resistance to horizontal movement being controlled by a friction pad and screw member.

In a preferred embodiment, the swing arm support is constructed of a metal such as steel with the horizontal support member and cap preferably being welded together. In one embodiment, the horizontal support member is in the form of a channel iron sized to receive a second support member such as 4×4 wooden post which is sized in length to position and a support mailbox at the correct location for mail delivery. The horizontal wooden support post is normally affixed in place through a plurality of U-bolts which are attached through holes drilled in the horizontal metal support arm. Positioning the swing arm support on top of the vertical support post overcomes the problems associated with rusting out and rupture of many of the prior art devices, and provides a simple, easy to maintain assembly which will survive the impact of an automobile, snow plow or other force, and is simply repositioned by hand back to its original position after being deflected. Alternatively, the swing arm support may be made of any other suitable material such as a high strength plastic. The device of the present invention contains no moving parts, and is therefore simple to maintain and economical to manufacture, and yet provides an efficient economical and reliable means for surviving a major impact blow to a mailbox.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
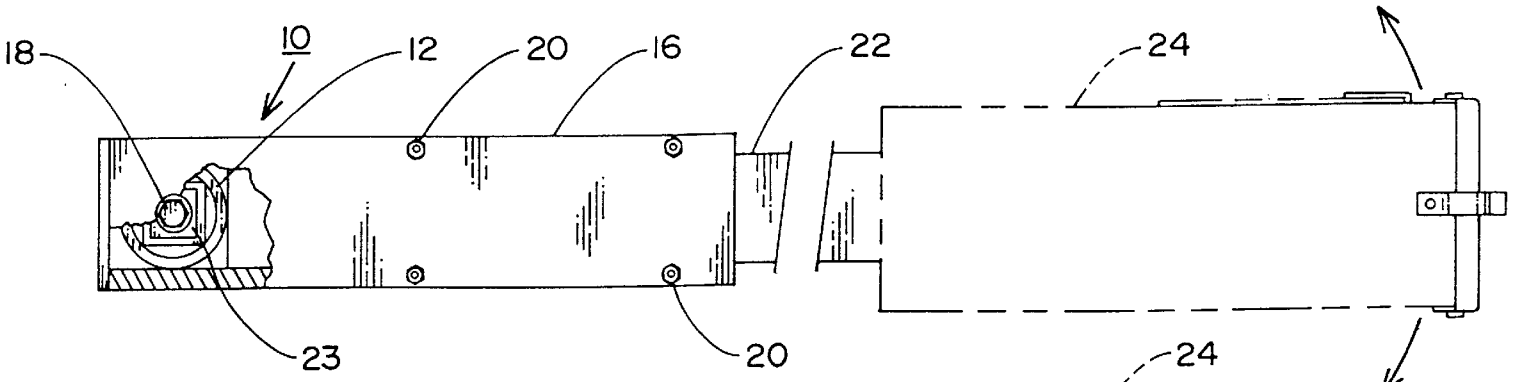
FIG. 1 illustrates a top plan view of the swing arm support of the present invention.

The present invention is illustrated more specifically with reference to drawings where in FIG. 1 the swing arm support is illustrated by (10) and includes a cylindrical cap member (12) which is designed to fit over vertical support post (30) in a loose rotating fit which is controlled by friction means to be described hereinafter more specifically. The cap (12) is integrally attached to a horizontal arm (16) in the form of a channel iron by welding the cap member along its top upper edge to the bottom flat surface of channel iron (16) (weld not shown). Top surface of channel iron (16) which effectively seals the top of cylindrical cap (12) includes a hole (17) which accommodates a lag screw (18) which screws into the top of wooden support post (30) and controls by frictional resistance the horizontal motion of swing arm support (10). Horizontal arm (16) further contains a plurality of holes (19) which accommodate two U-bolts (20) which are designed to hold a horizontal wooden support beam (22) of predetermined length in permanent fixed engagement as illustrated more clearly in FIGS. 2 and 3. The wooden support beam (22) is cut to an appropriate length to position a mail box (24) a predetermined distance to accommodate, mail delivery from a moving vehicle.

Figure 2:
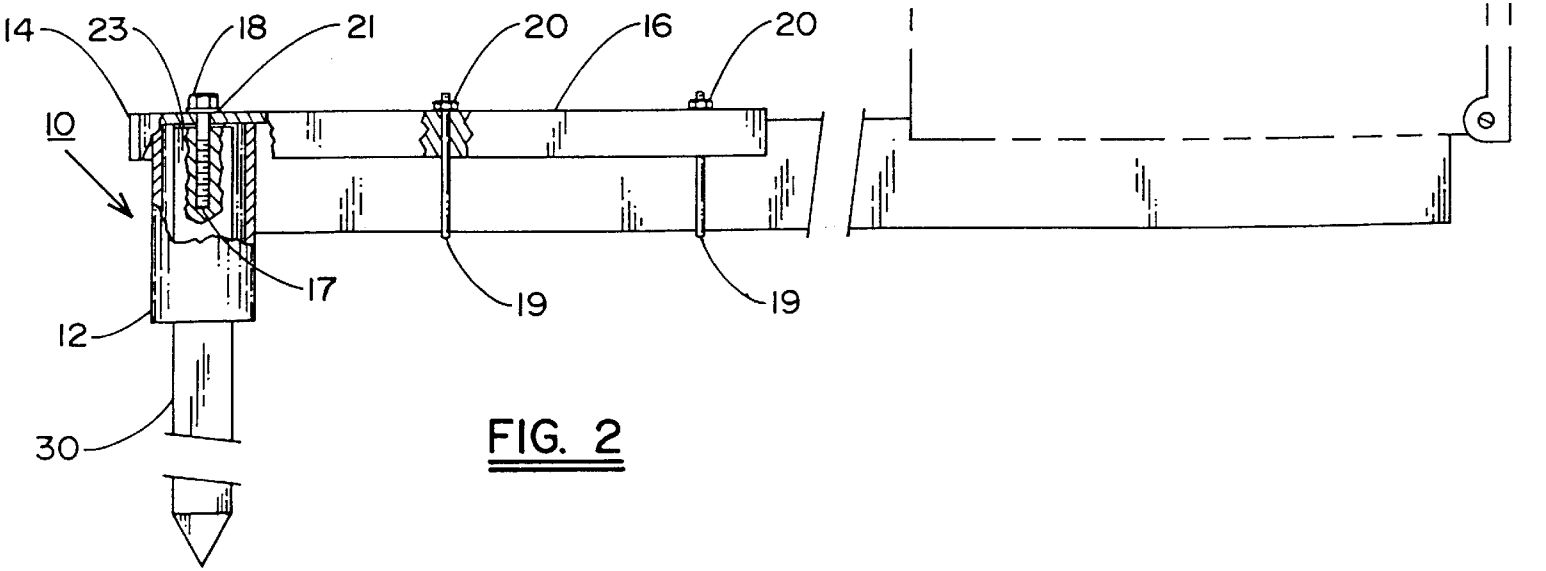
FIG. 2 illustrates by a side sectional view of the device of the present invention.
Figure 3:
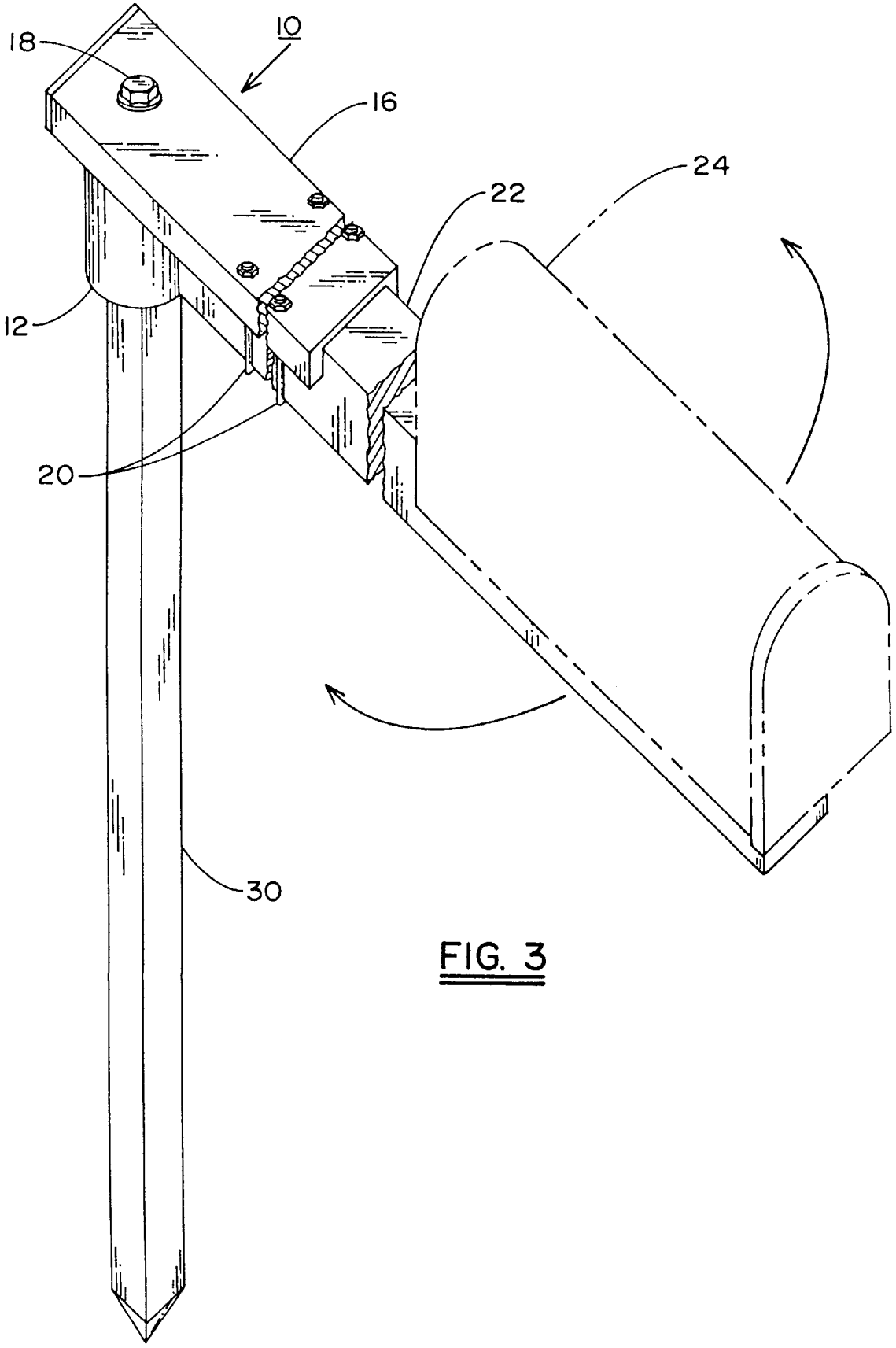
FIG. 3 illustrates a perspective view of the device of the present invention illustrating a complete mailbox assembly showing the mailbox positioned in phantom.

Operation of the swing arm support is illustrated more clearly in FIGS. 2 and 3 in which the swing arm support (10) is positioned in frictional rotating engagement over the top of vertical post (30) with friction being controlled by a lag bolt (18) associated washer (21) and optional friction pad (23). The friction pad (23) is positioned between the top of wooden post (30) and the bottom flat surface of channel iron (16). The friction pad (23) may be made of any suitable material such as plastic or leather. In one embodiment the friction pad comprises neoprene. Wooden support beam (22) is affixed through U-bolts (20) on horizontal arm (16). A mailbox (24) is attached to support beam (22) by any conventional means such as screws or bolts (not shown), and the friction of cap (12) controlled through a bolt (18) to allow the swing arm support (10) to rotate in a horizontal plane about the top of post (30). Horizontal rotational movement is illustrated by the arrows in FIG. 1.

In the event that the wooden support beam and/or mailbox are hit by a vehicle, or other object, or by moving snow from a plow, the entire assembly which comprises the swing arm support, wooden beam (22) and mailbox (24) is deflected and moves in a horizontal direction. This structure in most cases allows the support structure and vertical post to remain in tact after a "hit" and overcomes the necessity of replacing the vertical post and associated swing arm support, especially in cold weather when the frozen ground which would render such a task either difficult or impossible. Following an impact event which deflects the mailbox, the swing arm support is simply manually rotated back to its original position.

The device of the present invention provides a reliable, economical and effective means for allowing a mailbox support assembly and associated structure to survive an otherwise destructive event. The design of the device allows for ease of maintenance and reliability in that moisture cannot enter the device due to its design and being mounted on top of the vertical support post, and unlike other structures of the prior art, is not subject to freezing up and seizing during periods of ice, rain and low temperatures. The device contains no moving parts or springs and is therefore easy to install and simple to maintain.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A support assembly for a mailbox comprising:

(a) a hollow cylindrical cap member having an open bottom, closed top and a side wall with means for attaching said cylindrical member onto the top of a straight, solid vertical post in fixed rotating engagement; and (b) a horizontal support member perpendicularly attached to said side wall of said cylindrical member with means for attaching to and supporting a mailbox receiving arm in fixed engagement;

wherein the means for attaching said cylindrical member to the top of a vertical post comprise a screw which is positioned centrally through a hole in the center of the top of said cap member;

wherein a friction pad is positioned on the underside of the top of said cylindrical member, whereby in use said horizontal member functions to move in a horizontal plane through the rotation of said cylindrical cap member when said horizontal member receives a blow or impact from a snowplow blade.

2. The assembly of claim 1 in which said perpendicularly attached horizontal support member is a channel member.

3. The assembly of claim 2 in which said means for attaching said perpendicularly attached horizontal support member to said mailbox receiving arm are a plurality of U shaped bolts.

4. A mailbox and support structure comprising;

(a) a fixed straight, solid vertical support post having a substantially flat top;

(b) a rotatable support assembly in the form of a hollow cylindrical cap which is mounted over the top of said support post, said cap containing a closed upper top which contains a central hole, and an open bottom, with a horizontal support member perpendicularly attached to said cap and containing means to support a horizontal post in fixed engagement;

(c) a friction pad positioned between the underside of the closed upper top of said cylindrical cap and the top of said post;

(d) a horizontal post of predetermined length attached to said horizontal support member; and (e) a mailbox affixed to said horizontal post, whereby said horizontal post functions to move in a horizontal plane through the rotation of said support assembly when said horizontal post receives a blow or impact from a snowplow blade.

* * * * *